US007538297B2

(12) United States Patent
Anderson et al.

(10) Patent No.: US 7,538,297 B2
(45) Date of Patent: May 26, 2009

(54) APPLIANCE CONTROL WITH GROUND REFERENCE COMPENSATION

(75) Inventors: Peter M. Anderson, St Paul, MN (US); Rolf L. Strand, Crystal, MN (US)

(73) Assignee: Honeywell International Inc., Morristown, NJ (US)

( * ) Notice: Subject to any disclaimer, the term of this patent is extended or adjusted under 35 U.S.C. 154(b) by 117 days.

(21) Appl. No.: 11/458,006

(22) Filed: Jul. 17, 2006

(65) Prior Publication Data

US 2008/0023461 A1 Jan. 31, 2008

(51) Int. Cl.
*F23Q 7/00* (2006.01)
*F23N 5/00* (2006.01)

(52) U.S. Cl. ..... 219/260; 431/28

(58) Field of Classification Search ..... 219/260, 219/261, 262, 263, 264, 265, 266, 267, 268, 219/270, 269; 431/28, 43, 44, 45, 46, 47, 431/67, 71

See application file for complete search history.

(56) References Cited

U.S. PATENT DOCUMENTS 4,242,078 A * 12/1980 Nelson et al. ..... 431/45
4,925,386 A 5/1990 Donnelly et al.
5,076,780 A 12/1991 Erdman
5,725,368 A 3/1998 Arensmeier
5,865,612 A 2/1999 Hill et al.
5,951,276 A 9/1999 Jaeschke et al.
6,244,515 B1 * 6/2001 Rowlette et al. ..... 236/1 E
6,474,979 B1 11/2002 Rippelmeyer
6,521,869 B1 2/2003 Donnelly et al.
6,728,600 B1 4/2004 Contaldo et al.
6,777,653 B2 8/2004 Burkhart
6,880,548 B2 4/2005 Schultz et al.
2004/0060924 A1 * 4/2004 Burkhart ..... 219/497
2007/0007278 A1 * 1/2007 Chodacki et al. ..... 219/497

* cited by examiner

*Primary Examiner*—Daniel L Robinson

(57) ABSTRACT

Appliance control with ground reference compensation is provided. Ground reference compensation can be desirable when a device or component of an appliance is powered by a higher power source, and is controlled by a controller that is powered by a lower power source. In such a situation, a voltage difference can develop between the ground references of the higher and lower power sources, which can affect accurate control of the device or component. In some cases, a measure related to the voltage difference between the ground references is first determined, and then the power/voltage that is ultimately delivered to the device or component is adjusted or compensated based, at least in part, on the determined difference.

16 Claims, 14 Drawing Sheets

APPLIANCE CONTROL WITH GROUND REFERENCE COMPENSATION

FIELD

The present invention relates generally to appliance control, and more particularly, to appliance control with ground reference compensation.

BACKGROUND

Numerous fuel fired appliances have an igniter for igniting the fuel upon command. Fuel fired appliances include, for example, heating, ventilation, and air conditioning (HVAC) appliances such as furnaces, boilers, water heaters, as well as other HVAC appliances. Non-HVAC fuel fired appliances include, for example, clothes dryers, washing machines, stoves, ovens, as well as others.

Fuel fired appliances typically have a combustion chamber and a burner. A fuel source, such as a gas or oil, is typically provided to the burner through a valve or the like. In many cases, various electrical and/or electromechanical components are provided to help control and/or otherwise carry out the intended function of the fuel fired appliance. For example, various controllers, motors, igniters, blowers, switches, motorized valves, motorized dampers, and/or others, are often included in, or are used to support, a fuel fired appliance. Typically, these electrical and/or electromechanical components receive power from an electrical power source, such as a line voltage supply (e.g. 120 volt 60 Hz AC). The line voltage supply is often used to power higher power electrical and/or electromechanical components of the fuel fired appliance, such as blowers, igniters, etc., if any. In some cases, a transformer is provided to step down the incoming line voltage supply to a lower voltage supply that is useful in powering lower voltage electrical and/or electromechanical components if present, such as controllers, motorized valves or dampers, thermostats, etc. The lower voltage supply can be, for example, a 24 volt 60 Hz AC voltage.

In one example, a fuel-fired appliance may include an electronic ignition system, such as a hot surface igniter, for initiating burner ignition of the fuel-fired appliance. When activated, the hot surface igniter is typically configured to ignite gas in the burner of the fuel-fired appliance, without the need for a pilot light. Such electric ignition systems can often reduce gas consumption and increase the efficiency of the fuel-fired appliance.

There are several different types of hot surface igniters available for use in fuel-fired appliances. A few examples include silicon nitride igniters, silicon carbide igniters, and mini silicon carbide igniters. Hot surface igniters may be constructed from a variety of materials including, for example, aluminum nitride, silicon nitride, silicon carbide, boron carbide, tungsten disilicide, tungsten carbide, and/or mixtures thereof.

In some cases, hot surface igniters can provide some advantages over other types of igniters. However, due to the operating characteristics of the materials used in many of these igniters, as well as the extreme variations in temperature experienced by these igniters, proper control of the input power that is ultimately delivered to the hot surface igniter is often desirable to achieve optimum results. Providing too little power to the hot surface igniter can prevent the fuel-fired appliance from igniting because the hot surface igniter will not become hot enough. Providing too much power to the hot surface igniter can, in some cases, cause it to get too hot and prematurely burn out. As such, proper control of the power supply for the hot surface igniter can be desirable to achieve increased performance and a longer life for the hot surface igniter.

A hot surface igniter is often powered by a higher voltage supply, such as a line voltage supply, in order to achieve the desired temperature in a desired time period. The control of the activation and deactivation of the hot surface igniter is often controlled by a controller that is powered by a lower voltage supply, such as a microprocessor or the like. In some cases, a voltage difference may develop or be present between the ground reference of the line voltage supply and the ground reference of the lower voltage supply. This ground reference difference can cause control problems, particularly when, for example, a controller powered by a lower voltage supply is attempting to control an electrical component (such as a hot surface igniter) that is driven by a line voltage supply.

SUMMARY

The following summary is provided to facilitate an understanding of some of the innovative features unique to the present invention and is not intended to be a full description. A full appreciation of the invention can be gained by taking the entire specification, claims, drawings, and abstract as a whole.

The present invention relates generally to the control of power that is ultimately delivered to an electrical or electromechanical component, when at least part of the control is powered by a first voltage source and the electrical or electromechanical component is powered by a second voltage source. In some cases, a voltage difference may develop or be present between the ground reference of the first voltage supply and the ground reference of the second voltage supply. Ground reference compensation may be used to help better control the power that is ultimately delivered to the electrical or electromechanical component.

In one illustrative embodiment, the present invention may be applied to ignition control for fuel fired appliances, and more particularly, to ignition control with ground reference compensation. In some cases, a fuel fired appliance may include an electronic igniter for igniting a fuel in the burner of the fuel fired appliance. A controller may be provided to control the activation and deactivation of the igniter. The controller may be powered by a first voltage supply (e.g. a lower voltage supply) having a first ground reference, and the igniter may be powered by a second voltage supply having a second ground reference. In one illustrative embodiment, a measure related to the voltage difference between the first ground reference and the second ground reference may be determined, and the igniter voltage may be adjusted based, at least in part, on the measure that is related to the voltage difference. This may provide some level of ground reference compensation to the ignition control of the fuel fired appliance. Other methods and systems are also contemplated, as further described herein.

BRIEF DESCRIPTION

The invention may be more completely understood in consideration of the following detailed description of various illustrative embodiments of the invention in connection with the accompanying drawings, in which.

DETAILED DESCRIPTION

Figure 1:
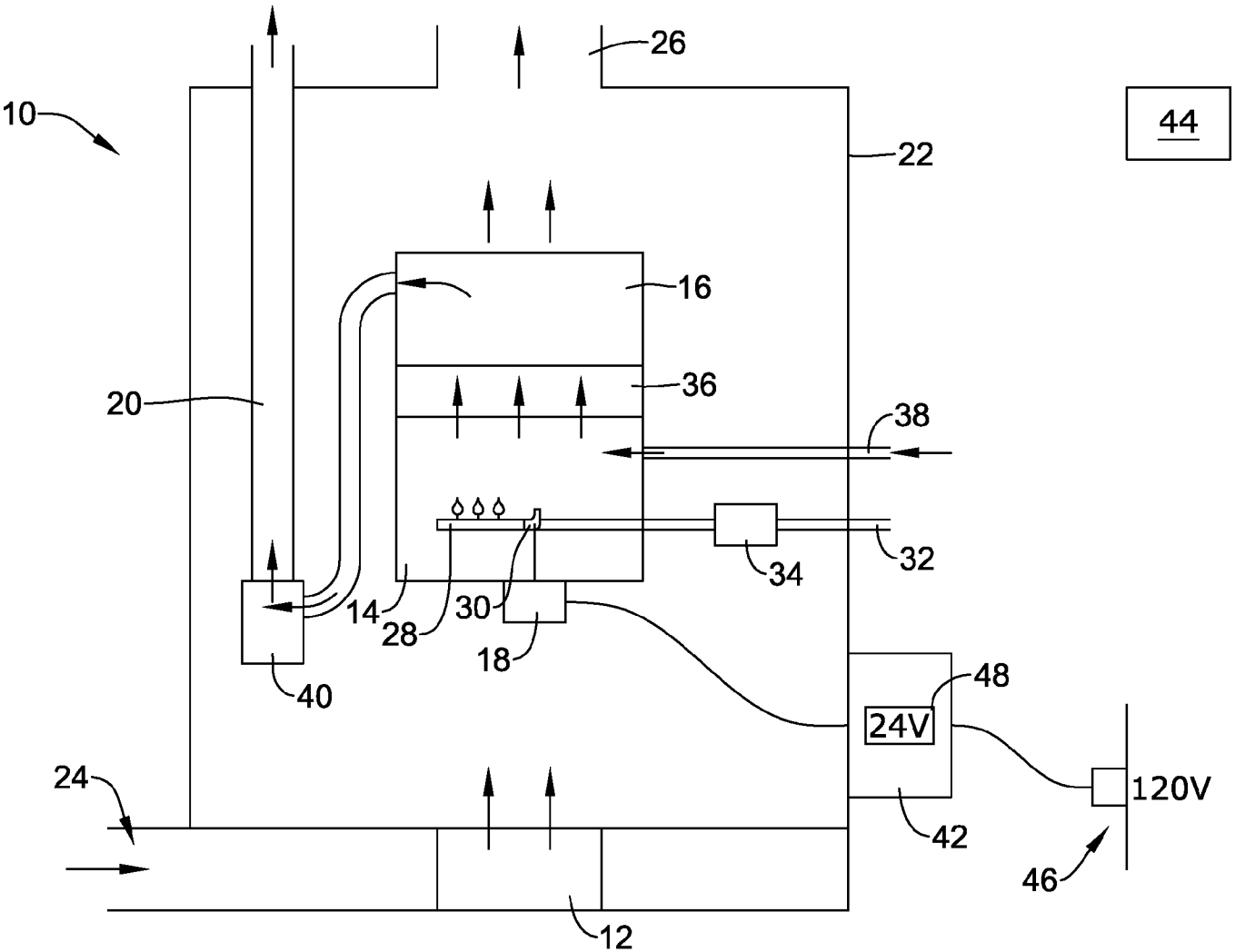
FIG. 1 is a cutaway side view of an illustrative fuel-fired appliance employing an electronic ignition system.

The following description should be read with reference to the drawings wherein like reference numerals indicate like elements throughout the several views. The detailed description and drawings show several embodiments which are meant to be illustrative of the claimed invention.

The present invention relates generally to the control of power that is ultimately delivered to an electrical or electromechanical component, when at least part of the control is powered by a first voltage source and the electrical or electromechanical component is powered by a second voltage source. In some cases, a voltage difference may develop or be present between the ground reference of the first voltage supply and the ground reference of the second voltage supply. Ground reference compensation may be used to help better control the power that is ultimately delivered to the electrical or electromechanical component.

In one illustrative embodiment, the present invention may be applied to ignition control for fuel fired appliances, and more particularly, to ignition control with ground reference compensation. Merely for illustrative purposes, and not to be intended as limiting in any manner, the discussion below focuses primarily on hot surface igniters for fuel-fired appliances and motor control. However, it should be understood that the present invention may be used to control any number of suitable electrical and/or electromechanical component including, for example, other igniter types, electric pumps, electric valves, fans, etc.

FIG. 1 is a cutaway side view of an illustrative fuel-fired appliance employing an electronic ignition system. The fuel-fired appliance, illustratively a gas furnace 10, includes a circulation fan or blower 12, a combustion chamber 14, a heat exchanger 16, an ignition controller 18, and an exhaust system 20, each of which can be housed within furnace housing 22 as shown. In some cases, the circulation fan 12 can be configured to receive cold air via a cold air return duct 24 of a building or structure. The cold air received may be circulated upwards through the furnace housing 22 across the heat exchanger 16, heating the air, and distributed the heated air through the building or structure for heating via one or more supply air ducts 26.

The illustrative combustion chamber 14 includes a burner assembly 28 to provide heating of the cold air received by the furnace. An ignition system can be provided which can include a flame rod and an igniter 30 coupled to ignition controller 18. The ignition controller 18 can be located adjacent the combustion chamber 14 as illustrated, mounted to the furnace housing 22, or situated in any other suitable location as desired. At times when heating is called for, the ignition controller 18 typically sends a signal that causes the igniter 30 to ignite. The igniter 30 can in turn ignite the fuel provided to the burner 28 via a gas line 32. In many cases, the gas line 32 may include a gas valve 34 to regulate the supply of gas to the combustion chamber 14.

In some cases, an inducer fan 36, provided within or adjacent to the heat exchanger 16, and in fluid communication with the combustion chamber 14, can be configured to draw fresh air via an air intake port 38, which may be used for combustion of the fuel in the combustion chamber 14. The combusted air may be drawn into the heat exchanger 16 by the inducer fan 36 and then discharged from the building via an exhaust vent 20. In some cases, a vent blower 40 is also provided in the exhaust vent 20 to help draw the combusted air into the exhaust vent 20 and direct the combusted air out of the building, but this is not required.

A controller 42 can be used to control various components of the gas furnace 10, including the ignition of the igniter 30, the speed and/or operation of the inducer fan 36, and the speed and/or operation of the circulator fan 12. In some cases, the controller 42 may also be configured to control various other components of the gas furnace 10 including any airflow damper (not shown), any sensors for detecting temperature or airflow (not shown), any gas valves 34, as well as any other suitable component as desired. In addition, the controller 42 may be configured to communicate with one or more thermostat controllers 44 for receiving heat request calls. The controller 42 may be linked to the one or more thermostats 44 via a communications bus (wired or wireless) upon which heat demand calls may be communicated to the furnace 10.

In the illustrative embodiment, controller 42 may be powered by a single phase line voltage 46, sometimes 120 volt, 60 Hz AC. The 120 volt AC supply 46 in the United States typically has three lines, L1, neutral, and earth ground. In some cases, controller 42 can also include a step down transformer 48 for supplying power to some of the other HVAC component devices such as controller components and/or circuitry. The step down transformer is often provided separate from the controller 42, but this is not required.

In one illustrative embodiment, the transformer 48 may have a primary winding connected to terminals L1 and neutral of the line voltage 46, and a secondary winding connected to the power input terminals of controller 42 to provide a lower voltage source, such as 24 volt, 60 Hz, AC. In some cases, the thermostat 44, ignition controller 18, and gas valves 34 may also operate on the lower voltage source (e.g. 24 volt AC), but this is not required.

In some cases, the controller 42 may provide power to some components at the higher line voltage 46. For example, and in some illustrative embodiments, the controller 42 may provide higher voltage signals to the inducer fan 36, circulator fan 12, hot surface igniter 30, and/or flame rods, as desired. Also, though not shown, some furnaces 10 may include a humidifier or an electrostatic air cleaner, which may operate on the higher line voltage.

Figure 2:
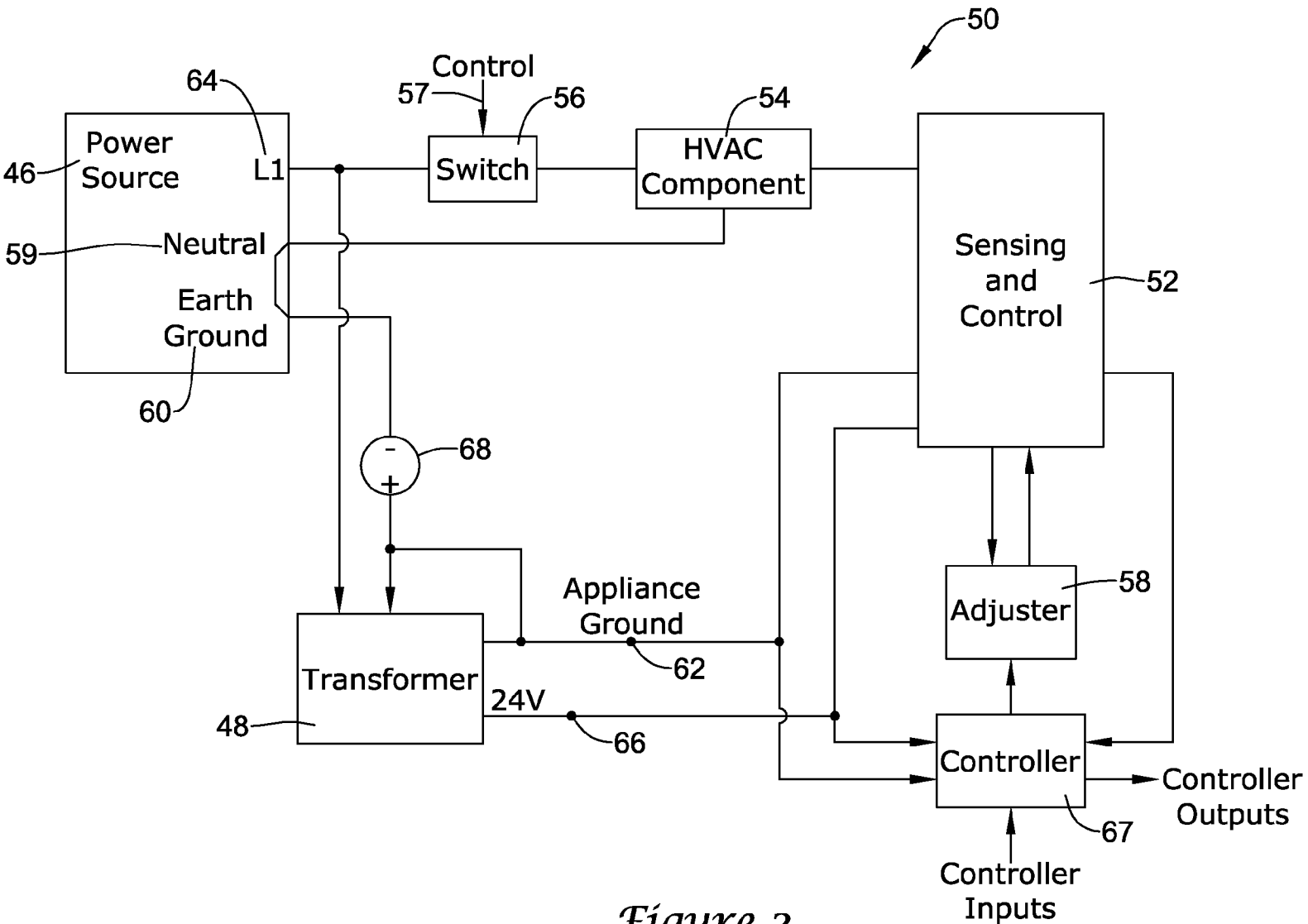
FIG. 2 is a block diagram of an illustrative embodiment of a ground compensation circuit in accordance with the present invention.

FIG. 2 is a block diagram of an illustrative embodiment of a ground compensation circuit 50 that can be used in the furnace of FIG. 1. In the illustrative embodiment, an HVAC component 54, such as a motor, igniter, flame rod, fan, humidifier, electrostatic air cleaner, or other higher voltage HVAC component 54, is provided and receives power from a higher voltage power source 46 (e.g. single phase 120 volt, 60 Hz AC voltage), as shown. The higher voltage source 46 may provide a line voltage signal (L1) 64 as well as a neutral signal 59 for powering the HVAC component 54. The higher voltage source 46 may also provide a reference ground (e.g. earth ground), with neutral signal 59 referenced to the reference ground (e.g. earth ground).

In some cases, a switch 56 or other control device may be provided in series with the HVAC component 54 to control, for example, activation and deactivation of the HVAC component 54. The switch 56 may be manually controlled, if desired, but in many cases, the switch 56 is controlled by one or more control signals 57 provided by a controller 67 or the like. In some cases, the switch 56 may be a triac, a relay, a transistor, or some combination thereof, as desired. More generally, the switch 56 may be any device capable of switching on and off power to the HVAC component device 54, and in some cases, of controlling the voltage level that is ultimately delivered to the HVAC component device 54.

The controller 67 may be a microprocessor, a microcontroller, or the like, and may be powered by a lower voltage power source (e.g. a rectified 5V source derived from a 24 volt, 60 Hz, AC signal). In the illustrative embodiment, a step down transformer 48 may be coupled to the higher voltage power source 46 to provide the lower voltage signal 66, which is referenced to a lower voltage ground reference 62 (e.g. appliance ground).

In some cases, it may be desirable to control the amount of power that is ultimately delivered from the higher voltage source 46 to the HVAC component 54. For example, and as described above, it may be desirable to maintain proper control over the power/voltage that is ultimately delivered to a hot surface igniter to achieve desirable results. Alternatively, or in addition, it may be desirable to maintain proper control over the power that is ultimately delivered to a variable speed motor to maintain proper control over the speed and/or position of the motor.

In some cases, a sensing and control circuit 52 may be provided for sensing the voltage that is provided to the HVAC component 54, and for helping to control the amount of voltage/power that is ultimately delivered to the HVAC component 54. In some cases, the sensing and control circuit 52 may sense the voltage that is applied to HVAC component 54 from the higher voltage supply 46. The sensing and control circuit 52, or parts thereof, may be powered through the lower voltage supply 48, which is referenced to the lower voltage ground reference 62. In some cases, the lower voltage ground reference 62 (e.g. appliance ground) of the lower voltage supply 48 may not be equal to the ground reference 60 (e.g. earth ground) of the higher voltage supply 46, as shown by symbol 68.

In the illustrative embodiment, symbol 68 may represent a voltage drop that is caused by a difference between the ground reference 62 (e.g. appliance ground) of the lower voltage supply 48 and the ground reference 60 (e.g. earth ground) of the higher voltage supply 46. This voltage difference 68 may be caused by, for example, a poor connection produced by a rusty ground screw, a painted metal surface, or some other reason. As a result of the voltage difference 68 in the ground references, at least in some cases, the actual voltage across the HVAC component device 54 may be different from the voltage that the sensing and control circuit 52 may measure/sense across the HVAC component device 54. In some cases, the actual voltage across the HVAC component device 54 may be greater than what is measured/sensed, which in the case of a hot surface igniter, may cause a premature burn out of the igniter. In other cases, the actual voltage across the HVAC component device 54 may be less than what is measured/sensed, which in the case of the hot surface igniter, may prevent the igniter from igniting properly or reliably.

In the illustrative embodiment of FIG. 2, the sensing and control circuit 52 may sense a measure related to the voltage difference 68 between the lower voltage ground reference 62 and the higher voltage ground reference 60. An adjuster 58 can be coupled to, or be part of, the sensing and control circuit 52, and can be configured to receive an input from the sensing and control circuit 52 that is related to the measure related to the voltage difference 68 between the lower voltage ground reference 62 and the higher voltage ground reference 60. The adjuster 58 may adjust the device voltage that is ultimately provided to the HVAC component device 54 such that the HVAC component device 54 is operated at the desired voltage level, such as, for example, a target voltage level. In some cases, the adjuster 58 may control the switch 56 or some other circuitry or component so as to adjust the device voltage that is ultimately provided to the HVAC component device 54. The adjuster 58 can include, for example, a microprocessor or a microcontroller, but this is not required in all embodiments. In some cases, the controller 67, sensing control circuit 52 and the adjuster 58 may be separate components or sub-assemblies, or part of an integrated controller, depending on the application.

Figure 3:
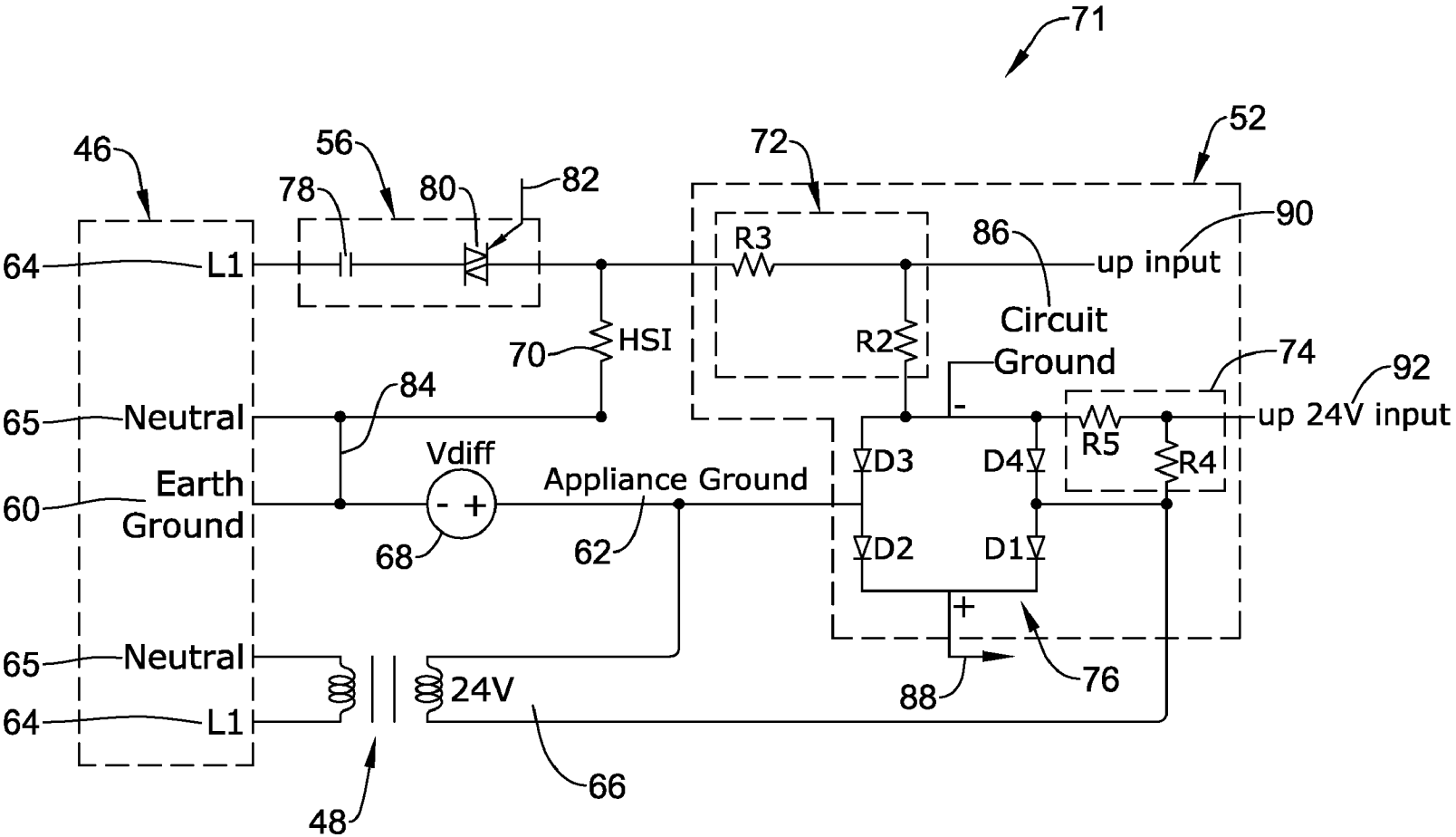
FIG. 3 is a schematic diagram of an illustrative embodiment of an ignition control circuit in accordance with the present invention.

FIG. 3 is a schematic diagram of another illustrative ignition control circuit 71 according to the present invention. Merely for illustrative purposes, and not to be intended as limiting in any manner, FIG. 3 is discussed primarily with respect to a hot surface igniter, although as indicated above, it is contemplated that the present invention may be applied to any suitable HVAC component device as desired.

The illustrative ignition control circuit 71 includes a sensing and control circuit 52, a hot surface igniter 70, and an igniter voltage control circuit 56. The sensing and control circuit 52 is referenced to a first ground reference 62 and the hot surface igniter 70 and igniter voltage control 56 are referenced to a second ground reference 60. An adjuster (not shown), such as, for example, a microprocessor, can also be provided and coupled to the sensing and control circuit 52. The ignition control circuit 71 may supply an igniter voltage to the hot surface igniter 70 to activate the igniter 70. The sensing and control circuit 52 may determine a measure related to the voltage difference 68 between the first ground reference 62 and the second ground reference 60. The adjuster may then adjust the igniter 70 voltage based, at least in part, on the measure that is related to the voltage difference 68 between the first ground reference 62 and the second ground reference 60.

In some cases, the igniter 70 may be an electronic ignition system, such as a hot surface igniter 70. The hot surface igniter 70, when activated, may ignite gas flow of a main burner of a furnace without the need for a pilot light. These electronic ignition systems can reduce gas consumption and increase the efficiency of a furnace, thereby increasing the efficiency of the HVAC system to which they are connected. Several different types of hot surface igniters 70 exist for use with gas appliances. The most common types include silicon nitride igniters, silicon carbide igniters, and mini silicon carbide igniters. Hot surface igniters may be constructed of different materials including aluminum nitride, silicon nitride, silicon carbide, boron carbide, tungsten disilicide, tungsten carbide, and mixtures thereof.

The illustrative hot surface igniter 70 may be a silicon nitride igniter, however, any suitable hot surface igniter 70 may be used, as desired. Additionally, for a silicon nitride igniter, in some cases, the minimum voltage across the hot surface igniter 70 for ignition may be about 95 volts. However, depending on the igniter 70 and the materials of the igniter 70, the minimum ignition voltage may be any value as desired. In some cases, for the illustrative silicon nitride igniter, the target voltage may be about 95 volts. In some cases, the target voltage may be an average voltage (VRMS) across the hot surface igniter 70 over a period of time.

In the illustrative embodiment, hot surface igniter 70 and igniter voltage control circuit 56 may be powered by single phase 120 volt, 60 Hz AC voltage 46, including L1 64, neutral 65, and earth ground 60 signals. Sensing circuit 52 may be powered by a step down transformer 48, which has its primary winding connected to terminals L1 64 and neutral 65, and its secondary winding connected to ignition controller 71 to provide a source of 24 volt, 60 Hz, AC voltage. The ground reference of the 120 volt AC voltage 48 (e.g. earth ground 60) may be different from the ground reference of the 24 volt AC voltage 48 (e.g. appliance ground 62) for a variety of reasons as discussed above. As a result, in some cases, the actual voltage across the igniter 70 may be different from the voltage the sensing and control circuit 52 senses across the igniter 70. In some cases, the actual voltage across the igniter 70 may be greater than what is expected, causing the igniter 70 to prematurely burn out. In other cases, the actual voltage across the igniter 70 may be less than what is expect, preventing the hot surface igniter 70 from igniting properly or reliably.

In the illustrative embodiment, the igniter voltage circuit 56 can control and regulate the supply of voltage 64 and/or current across the igniter 70. One side of the igniter voltage control circuit 56 may be connected to the line voltage (L1) 64 of the 120 volt AC power supply 46, and can include one or more switching components to switch the voltage across the igniter 70 on and off. In the illustrative embodiment, the one or more switching components may include a triac 80, a relay 78, a transistor, or any combination thereof, as desired. More generally, the igniter voltage circuit 56 may be any switch capable of switching on and off power to the igniter 70, as desired.

The sensing and control circuit 52 may sense a measure related to the voltage difference 68 between the first ground reference 62 (e.g. appliance ground) and the second ground reference 60 (e.g. earth ground). In the illustrative embodiment, the measure related to the voltage difference 68 between the appliance ground 62 and earth ground 60 may be determined by, for example, comparing the signal μp_24V_input 92 which is referenced to the appliance ground 62, and the signal μp_input 90 which is referenced to earth ground 60. In the illustrative embodiment, this comparison is made by a microprocessor (not shown). It should be noted that in the illustrative embodiment of FIG. 3, μp_input 90 is connected through resistors to 24V 66. However, either side (24V 66 or appliance ground 62) of transformer 48 could be used for this measurement.

The illustrative sensing and control circuit 52 includes multiple resistors R2, R3, R4, and R5 configured as two biasing networks 72 and 74, and multiple diodes D1, D2, D3, and D4 configured as a full wave bridge rectifier 76. A first biasing network 74 includes resistors R4 and R5, and a second biasing network 72 includes resistors R2 and R3. One purpose of the biasing networks 72 and 74 is to adjust the signal level of the sensing circuit 52 to a signal level (e.g. about 5 volts or less) that is compatible with the inputs of the microprocessor (not shown) that ultimately performs the comparison. The first biasing network 74 reduces the signal level according to the following equation:

$$V_{out}=V\text{in}*[R_5/(R_4+R_5)]$$

The second biasing network 72 reduces the signal level as follows:

$$V_{out}=V\text{in}*[R_2/(R_3+R_2)]$$

In the illustrative embodiment, R2 is about 100 kilohms, R3 is about 4.7 megaohms, R4 is about 51 kilohms, and R5 is about 7 kilohms. These illustrative resistor values can reduce the signal level of the sensing and control circuit 52 to less than 5 volts, which is compatible with many microprocessor inputs. Using the resistor values provided above, the illustrative first biasing network 74 can reduce the voltage according to the following equation:

$$V_{out}=V\text{in}*[0.121]$$

When a 24 volt signal from the step down transformer 48 is present, the 24 volt signal can be reduce to about 2.9 volts. Likewise, the second biasing network 72 can reduce the voltage according to the following equation:

$$V_{out}=V\text{in}*[0.021]$$

When a 120 volt signal from the line voltage is present, the 120 volt signal can be reduced to about 2.5 volts. It should be recognized that these resistor values are only illustrative, and it is contemplated that any size resistors R2, R3, R4, and R5, any type of biasing network 72 and 74, and/or any microprocessors input limits can be used, depending on the circumstances. Also, if the comparison of the signals μp_24V_input 92 and μp_input 90 is not made by a microprocessor, but rather some other circuit, the biasing networks may not be necessary at all.

Referring back to FIG. 3, and in the illustrative embodiment, the full wave bridge rectifier 76 includes four diodes, D1, D2, D3, and D4. The bridge 76 has two inputs including a first input located between cathode of diode D4 and anode of diode D2, and a second input located between anode of diode D1 and cathode of diode D3. The negative end of the bridge 76, located between the anodes of diodes D3 and D4, is connected to circuit ground 86, which is a floating ground relative to earth ground 60 and appliance ground 62. The positive end of the bridge 76, located between the cathodes of diodes D1 and D2, is connected to a power supply 88. The first input of the bridge 76 is coupled to appliance ground 62 and the second input of the bridge 76 is coupled to 24 volts, provided by the transformer 48.

A microprocessor (not shown) may, at least in part, control the operation of the ignition control circuit 71. The microprocessor may receive one or more inputs, such as μp_input 90 and μp_24V_input 92, from the sensing and control circuit 52, and may provide one or more outputs to the ignition control circuit 71, such as to the triac 80 via line 82. In some cases, the microprocessor may include on-board random access memory (RAM), read-only memory (ROM), EEPROM, FLASH, or any type of memory or combination of memory as desired. In addition, it is contemplated that a microcontroller may be used instead, or any other hardware and/or software based system, as desired.

In the illustrative embodiment, the microprocessor may determine a measure related to the voltage difference 68 between the first ground reference 62 (e.g. appliance ground) and the second ground reference 60 (e.g. earth ground) using the sensed μp_input 90 and μp__24V_input 92 signals. Note, the μp_input 90 signal is referenced to the second ground reference 60 (e.g. earth ground), and the μp__24V_input 92 signal is referenced to the first ground reference 62 (e.g. appliance ground). In one illustrative embodiment, the microprocessor may compare the sensed μp_input 90 signal to an expected μp_input 90 signal, where the expected μp_input 90 signal is based upon the μp__24V_input 92 signal and the known values of resistor R2, R3, R4, and R5. This comparison may allow the microprocessor to determine a measure related to the voltage difference 68 between appliance ground 62 and the earth ground 60.

In operation, the illustrative ignition control circuit 71 may sense the difference 68 between appliance ground 62 and earth ground 60 when the hot surface igniter 70 (HSI) is not activated. In this state, the μp_input 90 signal is provided from the first input of the full wave bridge 76, being a half-wave AC signal. This signal includes Vdiff 68, or the voltage difference 68 between appliance ground 62 and earth ground 60. The signal travels across the short 84 between earth ground 60 and neutral 65, then across the hot surface igniter 70. The hot surface igniter 70 typically has a negligible resistance (e.g. 50 to 100 ohms). The signal then travels across the second biasing network 72, including R2 and R3, and is input into the microprocessor as μp_input 90.

μp__24V_input 92 is provided from the second input of the full wave bridge 76. This signal is generated from the first biasing network 74, including R4 and R5, and is input into the microprocessor as μp__24V_input 92. In the deactivated state, the microprocessor is able to sense both signals 90 and 92, each referenced to different ground references 60 and 62. The microprocessor, knowing the resistor values of R2, R3, R4, and R5, can then determine a measure related to the voltage difference 68 between appliance ground 62 and earth ground 60.

In the activated state, when triac 80 and relay 78 switch on so that the line voltage 64 is across hot surface igniter 70, the microprocessor is not able to sense both earth ground 60 and appliance ground 62, and is not able to determine Vdiff 68. However, alternative embodiments described herein may allow the microprocessor to sense both earth ground 60 and appliance ground 62 in the activated state. In the activated state, $\mu p_{13}$ input 90 measures the 120 volt line voltage. This voltage passes through the igniter 70 causing the igniter 70 to ignite the HVAC component burners. Also, the 120 volts passes through biasing network include R2 and R3 and is input into microprocessor as μp_input 90. In this state, the μp_input 90 signal may be used by the microprocessor to determine what the voltage is across the igniter 70. However, if there is a ground reference voltage difference 68, this signal may include an error, which can be corrected by the microprocessor by adjusting the turn-on voltage of triac 80 via triac input 82.

Figure 4:
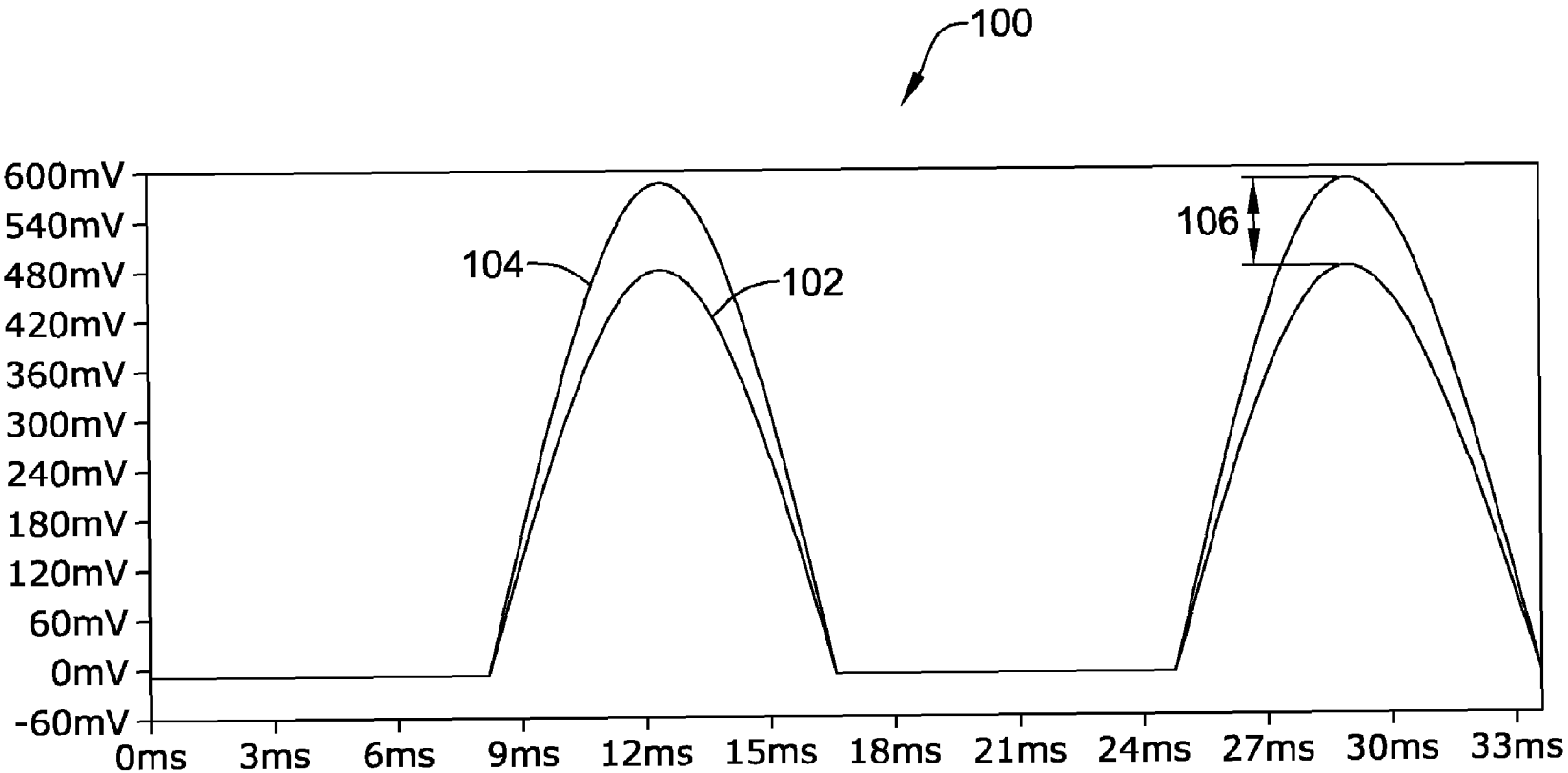
FIG. 4 is a graph showing an illustrative ground reference voltage for the circuit in FIG. 3.

FIG. 4 is a graph illustrating a ground voltage signal of the circuit in FIG. 3. The graph 100 shows an expected waveform at μp_input 104, and the measured waveform at μp_input 102. In the illustrative graph, the expected waveform 104 and the measured waveforms 102 are determined when the igniter is not energized, or when the voltage control switch has switched off the power to the igniter. However, it is contemplated, such as with the embodiment of FIG. 7, that the waveforms may be determined when the igniter is energized.

The measured waveform, shown as line 102, is what is actually seen by the microprocessor at the μp_input 90. The expected waveform, shown as line 104, is calculated by the microprocessor using the known resistor values of R2, R3, R4, and R5 and the information from the μp__24V_input signal. The microprocessor may determine the difference between the expected 104 and measured 102 waveforms, resulting in a ground voltage difference measurement 106. As illustrated in the graph, when a voltage difference in the ground references exists, the measured waveform 102 may be less than the expected waveform 104. The ground voltage difference measurement 106 may be determined by the difference that exists at the peaks of the two waveforms 102 and 104. However, it is contemplated that the ground voltage difference measurement 106 may be determined at other positions along the waveforms, as desired. In some cases, the ground voltage difference measurement 106 may be stored in the microprocessor or in other memory for later use, such as to adjust the igniter voltage when in the activated state.

Figure 5:
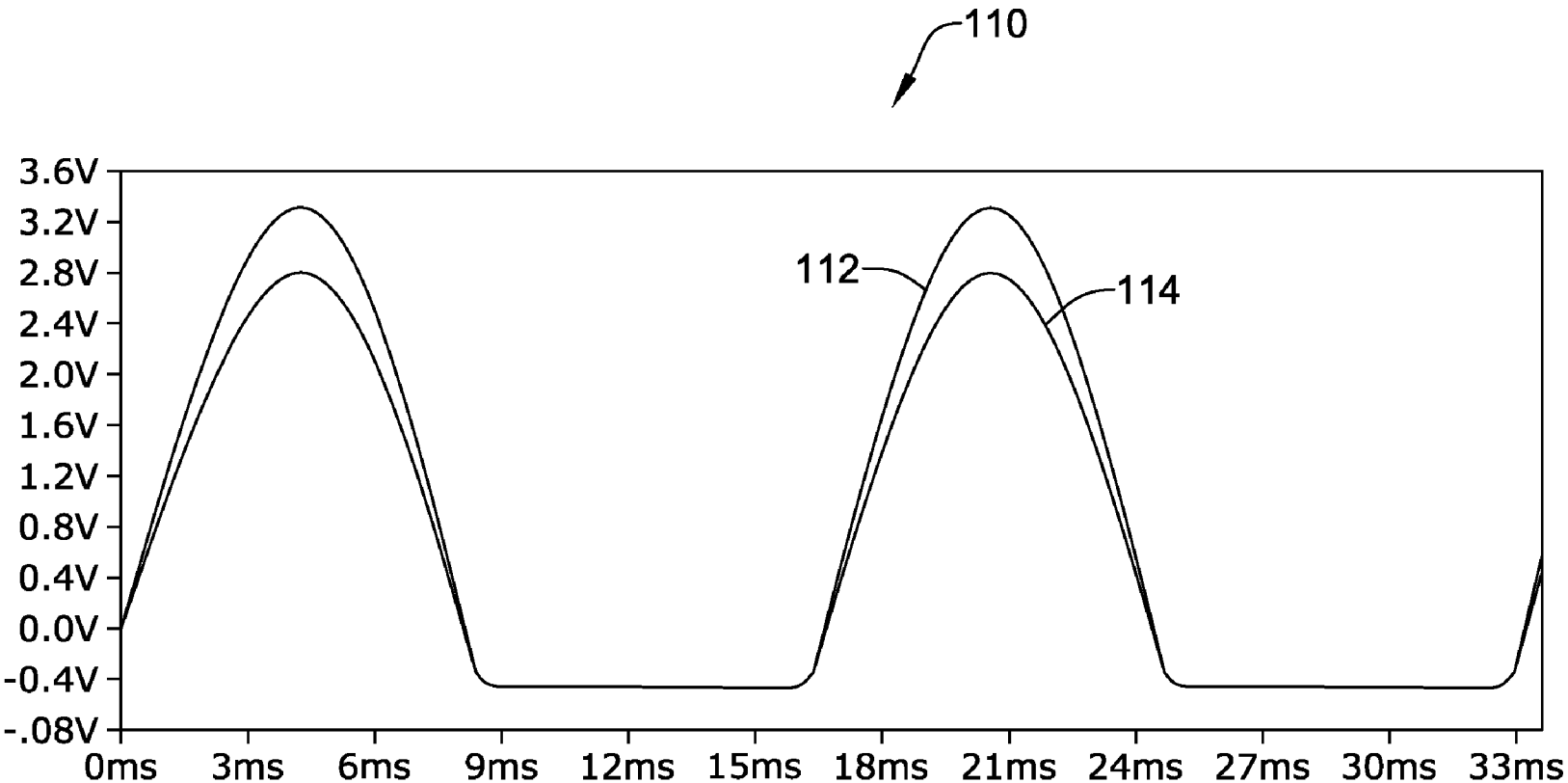
FIG. 5 is a graph showing an illustrative line voltage for the circuit in FIG. 3.

FIG. 5 is a graph 110 showing a line voltage of the circuit in FIG. 3. The illustrative graph 110 shows the voltage that may be seen at μp_input while the igniter is energized. A first waveform, as shown at line 112, shows a voltage measurement at μp_input 90 with no voltage difference between appliance ground and earth ground. A second waveform, as shown at line 114, shows a voltage measurement at μp_input 90 with a voltage difference between the appliance and earth ground. As can be seen, and in the illustrative embodiment, the presence of a voltage difference between appliance ground and earth (e.g. igniter) ground decreases the voltage of the resulting waveform. This may lead the microprocessor or controller to adjust or supply a higher voltage to the igniter than if no voltage difference were present between the appliance ground reference and the earth (e.g. igniter) ground reference.

Figure 6:
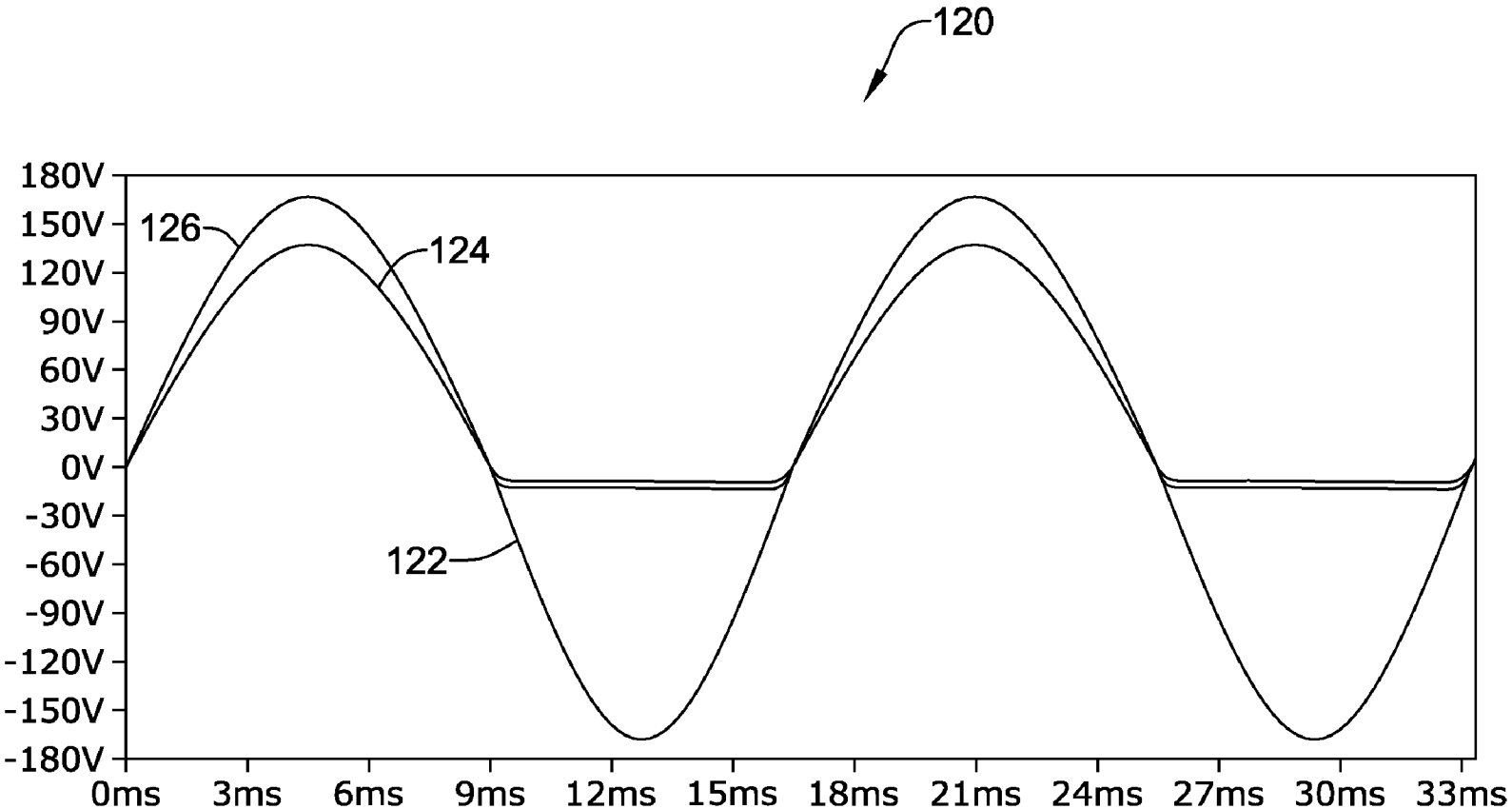
FIG. 6 is a graph showing an illustrative ground compensation for the circuit of FIG. 3.

FIG. 6 is a graph 120 of the ground compensation of the circuit of FIG. 3. Line 122 illustrates the actual line voltage that exists across the igniter. Line 124 is the calculated line voltage, or what the microprocessor calculates the line voltage to be based on the voltage seen at μp_input 90 and the known resistor values. Line 126 is the adjusted voltage. The adjusted voltage 126 is determined by adjusting the calculated line voltage 124 by a measure related to the ground voltage difference measurement value 106, shown in FIG. 4. The adjusted voltage 126 may be adjusted to be similar or nearly identical to the actual line voltage 122. Without the voltage adjustment, the microprocessor may calculate a lower voltage (or in some cases a higher voltage) than is actually present across the igniter, resulting in the microprocessor providing an overvoltage to the igniter and potentially causing it to prematurely fail. Note, in this illustrative embodiment, measurements are made during the positive half cycle, and the voltage during the negative half cycle is not calculated. However, in other embodiments, the voltage during the negative half cycle, or the voltage during the positive and negative half cycles may be employed, if desired.

Figure 7:
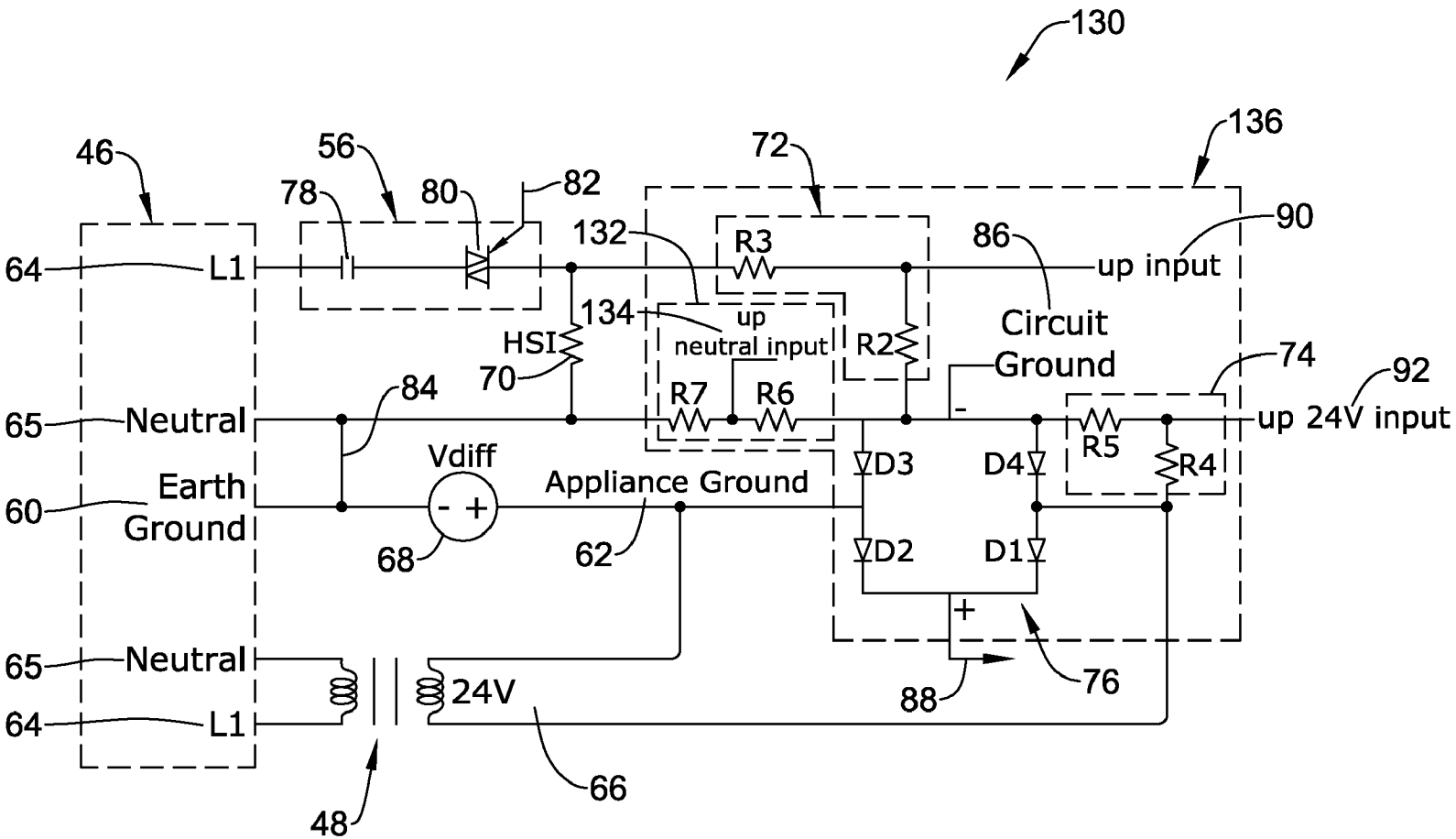
FIG. 7 is a schematic diagram of a variation of the ignition control circuit of FIG. 3.

FIG. 7 is a schematic diagram of a variation of the ignition control circuit of FIG. 3. While similar to FIG. 3, this embodiment includes the ability to sense the voltage difference 68 when the hot surface igniter 70 is activated, and/or when it is deactivated. This illustrative embodiment includes an extra biasing network 132 and input to the microprocessor, μp_neutral_input 134. The additional biasing network 132 includes resistors R6 and R7, which are referenced to circuit ground 86 (see FIG. 3). In the illustrative embodiment, R6 may be about 100 kilohms and R7 may be about 4.7 megaohms, providing a similar biasing network as described above with reference to biasing network 72 in FIG. 3.

In this embodiment, when the hot surface igniter 70 is activated, μp_neutral_input 134 may be used to sense earth ground 60, allowing it to be compared with μp_24V_input 92 as described above relating to μp_input 90. Thus, the microprocessor may be able to determine a measure related to the voltage difference 68 between appliance ground 62 and earth ground 60 when the hot surface igniter is activated.

Figure 8:
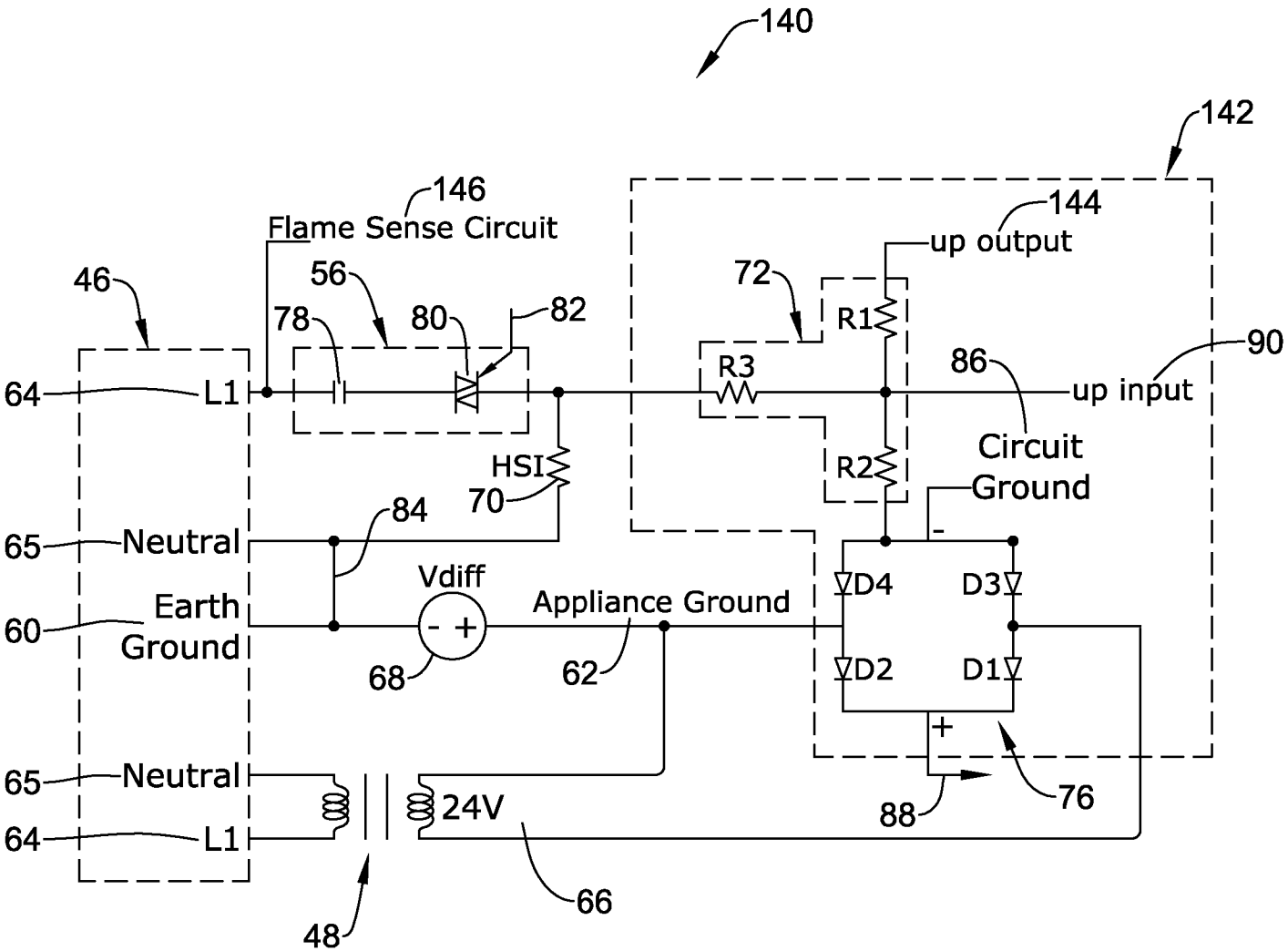
FIG. 8 is a schematic diagram of another illustrative embodiment of an ignition control circuit.

FIG. 8 is a schematic diagram of another illustrative embodiment of an ignition control circuit 140. Similar to FIG. 3, the illustrative ignition control circuit 140 includes a sensing circuit 142, a hot surface igniter 70, and an igniter voltage control circuit 56. In the illustrative embodiment, the sensing circuit 142 is referenced to a first ground reference 62 (e.g. appliance ground), and the hot surface igniter 70 and igniter voltage control 56 are referenced to a second ground reference 60 (e.g. earth ground).

An adjuster, such as, for example, a microprocessor (not shown), can be provided and coupled to the sensing circuit 142. The ignition control circuit 140 may supply an igniter voltage to the hot surface igniter 70 to activate the igniter 70. The sensing circuit 142 may determine a measure related to the difference 68 between the first ground reference 62 (e.g. appliance ground) and the second ground reference 60 (e.g. earth ground). The adjuster can then adjust the igniter 70 voltage based, at least in part, on the measure that is related to the voltage difference 68 between the first ground reference 62 and the second ground reference 60. The adjuster may do this by controlling the triac 80 via triac input 82. Furthermore, the illustrative ignition control circuit 140 may detect the ground reference voltage difference 68 regardless of polarity. In this embodiment, a flame sensing circuit 146 may be connected to L1 64, which may in some cases complicate the measurement by providing a voltage divider effect on line L1 64.

Similar to above, hot surface igniter 70 and igniter voltage control circuit 56 may be powered by single phase 120 volt, 60 Hz AC voltage 46, including L1 64, neutral 65, and earth ground 60. In the illustrative embodiment, the sensing circuit 142 may be powered by step down transformer 48, which has its primary winding connected to terminals L1 64 and neutral 65, and its secondary winding for providing a lower voltage source (e.g. 24 volt, 60 Hz, AC).

The ground reference of the 120 volt AC voltage (e.g. earth ground 60) may be different from the ground reference of the 24 volt AC voltage (e.g. appliance ground 62) for a variety of reasons as discussed above. As a result, in some cases, the actual voltage across the igniter 70 may be different from the voltage the control circuit senses across the igniter 70. In some cases, the actual voltage across the igniter 70 may be greater than what is expected, causing the igniter 70 to prematurely burn out. In other cases, the actual voltage across the igniter 70 may be less than what is expect, sometimes preventing the hot surface igniter 70 from igniting properly or reliably.

In the illustrative embodiment, the igniter voltage circuit 56 can control and regulate the supply of power/voltage 64 to the igniter 70. One side of the igniter voltage control circuit 56 may be connected to the line voltage 64 of the 120 volt AC power supply 46, and may include one or more switching components to switch the voltage across the igniter 70. In some cases, the one or more switching components may include a triac 80, a relay 78, a transistor, or any combination thereof, as desired. More generally, the igniter 70 voltage circuit may be any switch or control device that is capable of switching on and off power to the igniter 70, as desired.

The sensing circuit 142 may sense a measure related to the voltage difference 68 between the first ground reference 62 and the second ground reference 60. In the illustrative embodiment, the measure related to the voltage difference 68 between the appliance ground 62 and earth ground 60 may include, for example, a measure related to a bias signal that is referenced to earth ground 60 (e.g. μp_input 90).

The illustrative sensing circuit 142 includes multiple resistors R1, R2 and R3 configured as a biasing network 72, and multiple diodes D1, D2, D3, and D4 configured as a full wave bridge rectifier 76. The biasing network 72 includes resistors R1, R2 and R3. One purpose of the biasing network 72 is to adjust the signal level of the sensing circuit 142 to a signal level that is compatible with the inputs of a microprocessor (e.g. about 5 volts or less) or the like. In the illustrative embodiment, biasing resistor R1 is about 200 kilohms, R2 is about 200 kilohms, and R3 is about 4.7 megaohms. R1, R2 and R3 form a similar biasing network 72 as discussed previously when μp_output 144 is driven low. In some cases, μp_output 144 can be a digital output from a microcontroller that can change states from 0V to 5V, for example. These illustrative resistor values in the biasing network 72 can reduce the signal level of the sensing circuit 142 to less than 5 volts, which is the illustrative limit for the microprocessor inputs.

The full wave bridge rectifier 76 includes four diodes, D1, D2, D3, and D4. The bridge 76 has two inputs, a first input located between cathode of diode D4 and anode of diode D2, and a second input located between anode of diode D1 and cathode of diode D3. The negative end of the bridge 76, located between the anodes of diodes D3 and D4, is connected to circuit ground 86, which is a floating ground relative to earth ground 60 and appliance ground 62. The positive end of the bridge 76, located between the cathodes of diodes D1 and D2, is connected to a power supply 88. The first input of the bridge 76 is coupled to appliance ground 62 and the second input of the bridge 76 is coupled to 24 volts source 66, provided by the transformer 48.

In the illustrative embodiment, the microprocessor (not shown) at least in part controls the operation of the ignition control circuit 140. The microprocessor may receive one or more inputs, such as μp_input 90, from the sensing circuit 142 and may also provide one or more outputs, such as μp_output 144, to the ignition control circuit 140. In some cases, the microprocessor may include on-board random access memory (RAM), read-only memory (ROM), EEPROM, FLASH, or any type of memory or combination of memory as desired. In addition, it is contemplated that a microcontroller or other control circuitry may be used instead, as desired.

The microprocessor may determine a measure related to the voltage difference 68 between the first ground reference (e.g. appliance ground 62) and the second ground reference (e.g. earth ground 60) using the sensed μp_input 90. The μp_output 144 may be used to bias the μp_input 90 signal. In the illustrative embodiment, the microprocessor may compare the sensed μp_input 90 signal to an expected μp_input 90, where the expected μp_input 90 is based on the biased μp_output 144 signal and the known resistor values R1, R2, and R3. This comparison may allow the microprocessor to determine a measure that is related to the voltage difference 68 between appliance ground 62 and the earth ground 60.

In operation, the illustrative ignition control circuit 140 may sense the voltage difference 68 between appliance ground 62 and earth ground 60 when the hot surface igniter 70 (HSI) is not activated. In this state, the μp_input 90 signal is provided from the first input of the full wave bridge 76, being a half-wave AC signal. The signal includes Vdiff, or the voltage difference 68 between appliance ground 62 and earth ground 60. The signal travels across the short 84 between earth ground 60 and neutral 65, and then across the hot surface igniter 70. The signal then travels across the biasing network 72, including R1, R2 and R3, and is input into the microprocessor as μp_input 90. The microprocessor may then drive μp_output signal 144 high to bias the μp_input signal 90 across the mid-rail to see negative swings. In the deactivated state, the microprocessor is able to determine a measure related to the voltage difference 68 of the ground references based on the known resistor values R1, R2, and R3 and the biased signal.

In the activated state, when the triac 80 switches on so the line voltage 64 is provided across hot surface igniter 70, the microprocessor is not able to see earth ground 60 through μp_input 90. However, alternative embodiments described herein may allow this measurement when activated. In the activated state, the 120 volt line voltage 46 passes through the igniter 70 causing the igniter 70 to ignite the HVAC component burners. Also, the 120 volts line voltage passes through biasing network 72 and is input into microprocessor as μp_input 90. In this state, the μp_input 90 signal may be used by the microprocessor to determine the voltage level that is currently across the igniter 70. However, if there is a ground reference voltage difference 68, this signal may include an error signal, which can be corrected for by varying or adjusting the voltage that is provided to the triac 80 via triac control signal 82.

Figure 9:
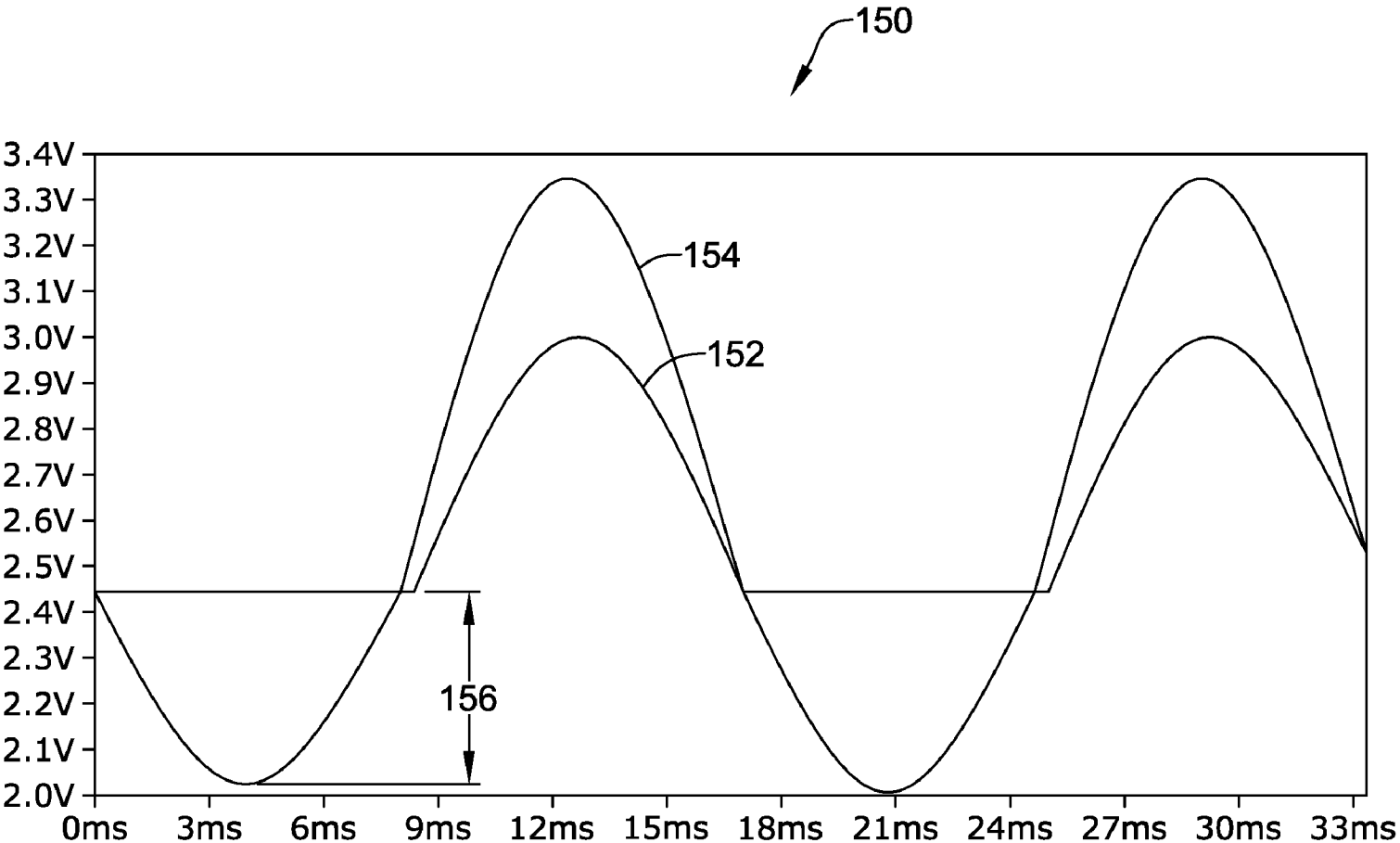
FIG. 9 is a graph showing an illustrative ground voltage of the circuit in FIG. 8.

FIG. 9 is a graph 150 of the ground voltage of the circuit in FIG. 8. The graph shows an expected waveform at μp_input, shown as line 152, and the measured waveform at μp_input, shown as line 154. In the illustrative embodiment, the expected waveform 152 and the measured waveform 154 are determined when the igniter is not energized (e.g. the voltage control switch 80 has switched off the power to the igniter). However, it is contemplated, such as with the embodiment of FIG. 12, that the waveforms 152 and 154 may be determined when the igniter is energized.

The measured waveform 154 is what is actually seen by the microprocessor at the μp_input 90. During this measurement, μp_output can be driven high to bias μp_input around the mid-rail. The expected waveform 152 may then be calculated by the microprocessor using the known resistor values of R1, R2, and R3. The microprocessor may determine the difference between the expected 152 and measured 154 waveforms at a particular point or points in the line cycle to provide a measure of the ground voltage difference measurement 156. As illustrated in the graph, when a voltage difference in the ground references is present, the measured waveform 154 may be less than the expected waveform 152 at the points measured. This measurement may be stored in the microprocessor or in other memory for later use, such as to adjust the igniter voltage. There may be some feed through from the flame sensing circuit (not shown) to the full wave bridge rectifier, but this may not be present in all embodiments.

Figure 10:
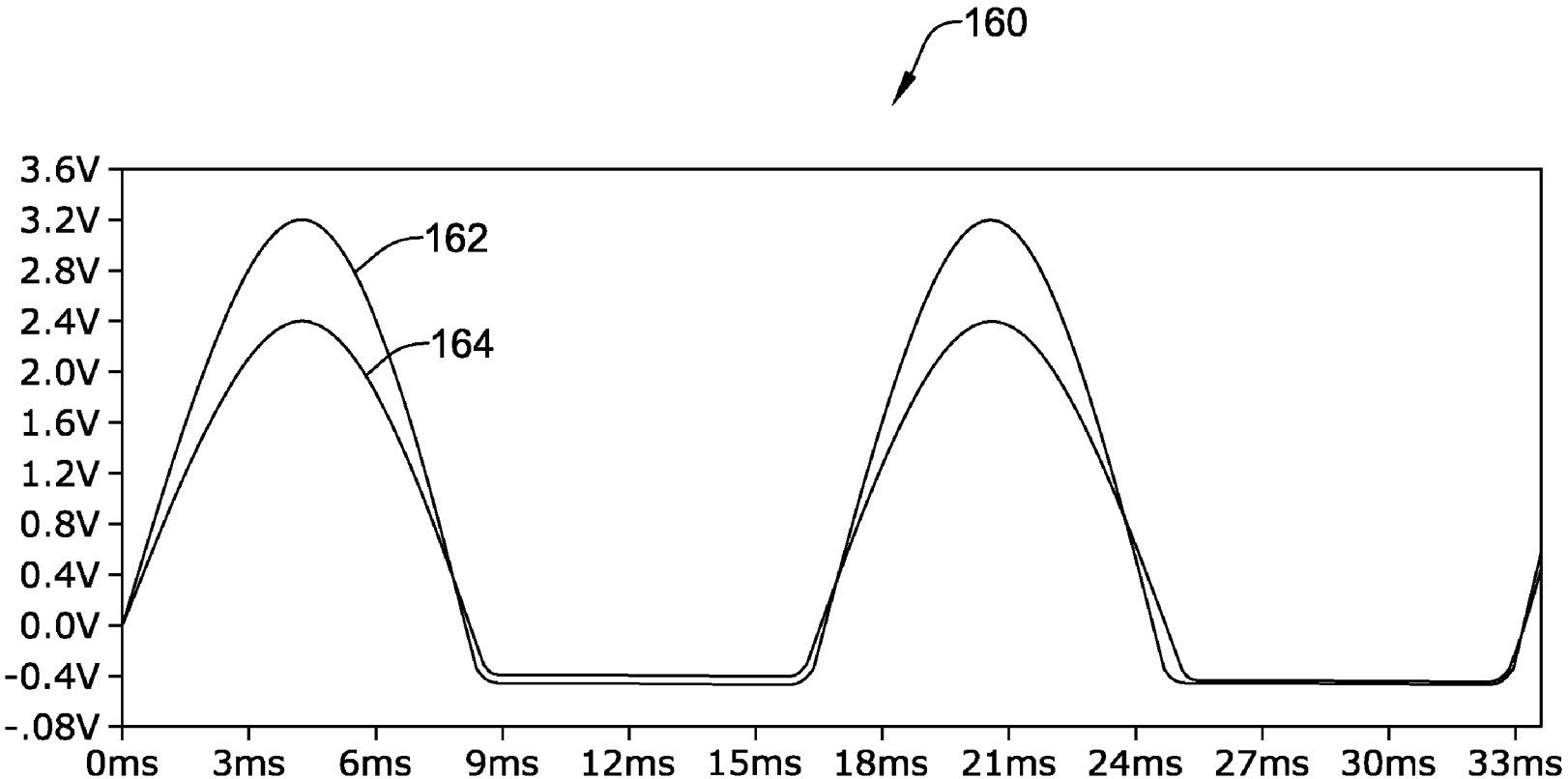
FIG. 10 is a graph showing an illustrative line voltage for the circuit in FIG. 8.

FIG. 10 is a graph 160 of the line voltage measurement of the circuit in FIG. 8. The illustrative graph 160 shows the voltage that may be seen at μp_input 90 while the igniter is energized. A first waveform, shown at line 162, shows a voltage measurement at μp_input 90 with no voltage difference between the appliance and earth ground. A second waveform, line 164, shows a voltage measurement at μp_input with a voltage difference between the appliance and earth ground. As can be seen, and in the illustrative graph, the presence of a voltage difference between the appliance ground reference and the igniter ground reference decreases the voltage of the waveform. With no compensation, this may lead the microprocessor or controller to supply a higher voltage to the igniter than desired.

Figure 11:
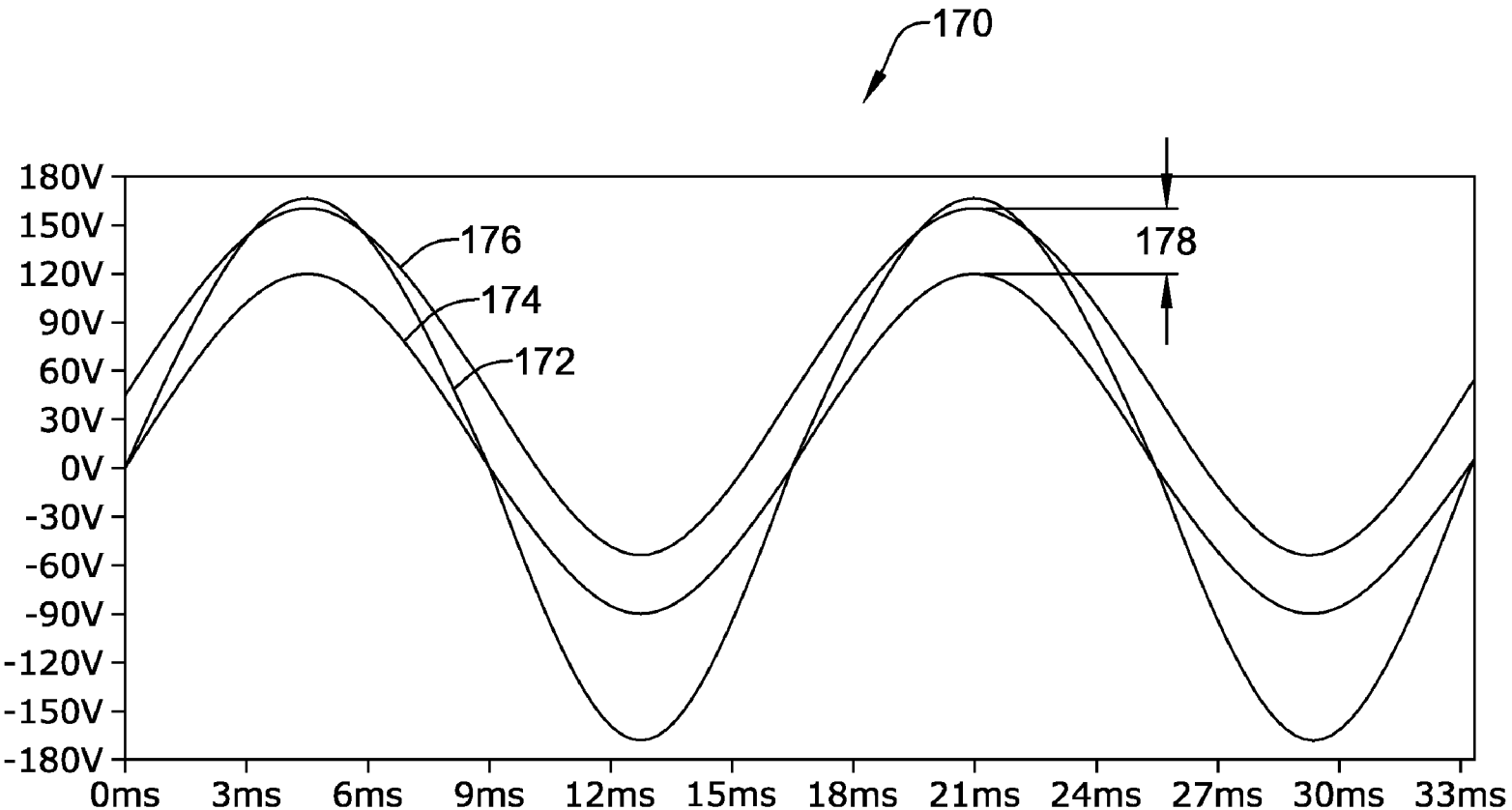
FIG. 11 is a graph showing an illustrative ground compensation for the circuit of FIG. 8.

FIG. 11 is a graph 170 of the ground compensation of the circuit of FIG. 8. Line 172 illustrates the actual line voltage that is across the igniter. Line 174 is the calculated line voltage, or what the microprocessor calculates the line voltage to be, based on the voltage seen at μp_input 90 and the known resistor values. Line 176 is the adjusted voltage. The adjusted voltage 176 is determined by adjusting the calculated line 174 voltage by a measure related to the ground voltage difference measurement value 156 shown in FIG. 9. The surface igniter in FIGS. 3-6, and may also be configure to include the alternative embodiment similar to that described with reference to FIG. 7. The illustrative motor 192 may be the motor 192 of a blower/circulator fan, an inducer fan, damper or any other device. In some cases, the illustrative motor 192 may be variably controlled according to a voltage across the motor 192. Also, the illustrative motor 192 may be referenced to earth ground 60, similar to the igniter, whereas the sensing circuitry 52 or controlling circuitry may be referenced to an appliance ground 62. Thus, any difference 68 in ground reference may cause a different motor speed than what is expected. The illustrative circuitry may determine the ground reference voltage difference 68 similar to that described previously with reference to the hot surface igniter.

Figure 14:
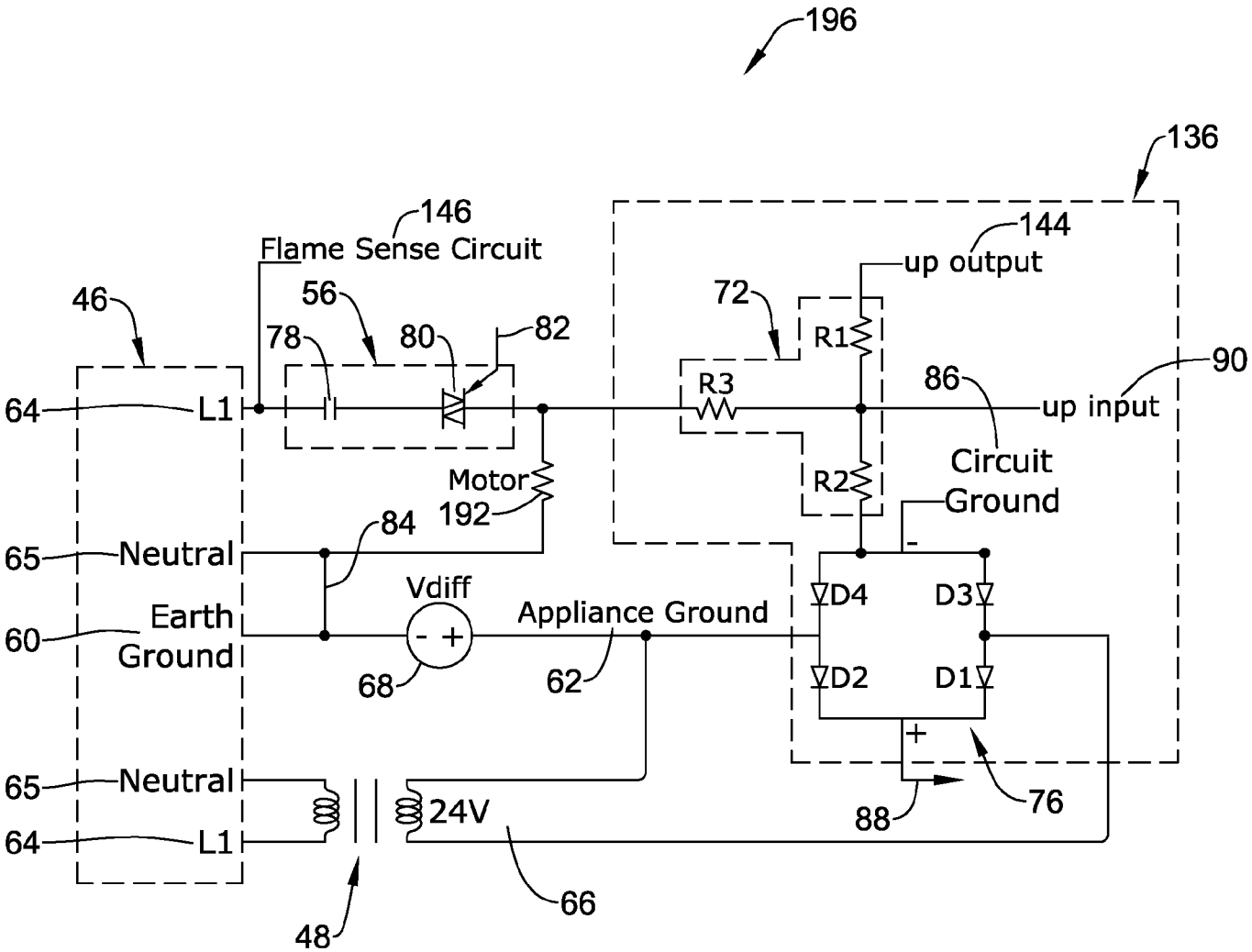
FIG. 14 is a schematic diagram of another illustrative embodiment of an appliance motor control circuit.

FIG. 14 is another illustrative embodiment of an appliance motor control circuit 196. This illustrative embodiment is similar to that described above with reference to the hot surface igniter in FIGS. 8-11, and may also include the alternative embodiment similar to that described with reference to FIG. 12. The illustrative motor 192 may be the motor 192 of a blower/circulator fan, an inducer fan, damper or any other device. Additionally, the illustrative motor 192 may be variably controlled according to a voltage across the motor 192. Also, motor 192 may be referenced to earth ground 60, similar to the igniter, whereas the sensing circuitry 142 or controlling circuitry may be referenced to appliance ground 62. Thus, any difference in ground reference may cause a different motor speed than expected. The illustrative circuitry may determine the ground reference voltage difference 68 similar to that described previously with reference to the hot surface igniter.

In some cases, the power supplies 46 and 48 may be in phase, but this is not meant to be limiting and the foregoing embodiments may be used with out-of-phase power supplies. In some cases, if the 120 volt line voltage 46 and the 24 volt power supply 48 are out-of-phase, the 24 volt power supply may need to be subtracted from the microprocessor input adjusted voltage 176 can be similar or, in some cases, nearly identical to the actual line voltage 172 at particular points in the line cycle. Without the voltage adjustment 178, the microprocessor may calculate a lower voltage than is actually across the igniter, which may cause the microprocessor to overvoltage the igniter and potentially causing it to prematurely fail or burn out.

The difference in the voltage on the negative half cycles is caused by the phasing relationship of the line voltage and the 24 volt transformer. In this illustrative embodiment, the calculated line voltage 174 is based on the full wave bridge ground, which may be sitting negative with respect to earth ground during the negative half cycles. The net effect may be a reduction in the voltage difference between earth ground and circuit ground. The can be overcome by making calculations during the positive half of the cycle, or while the bridge ground is approximately equal to earth ground.

Figure 12:
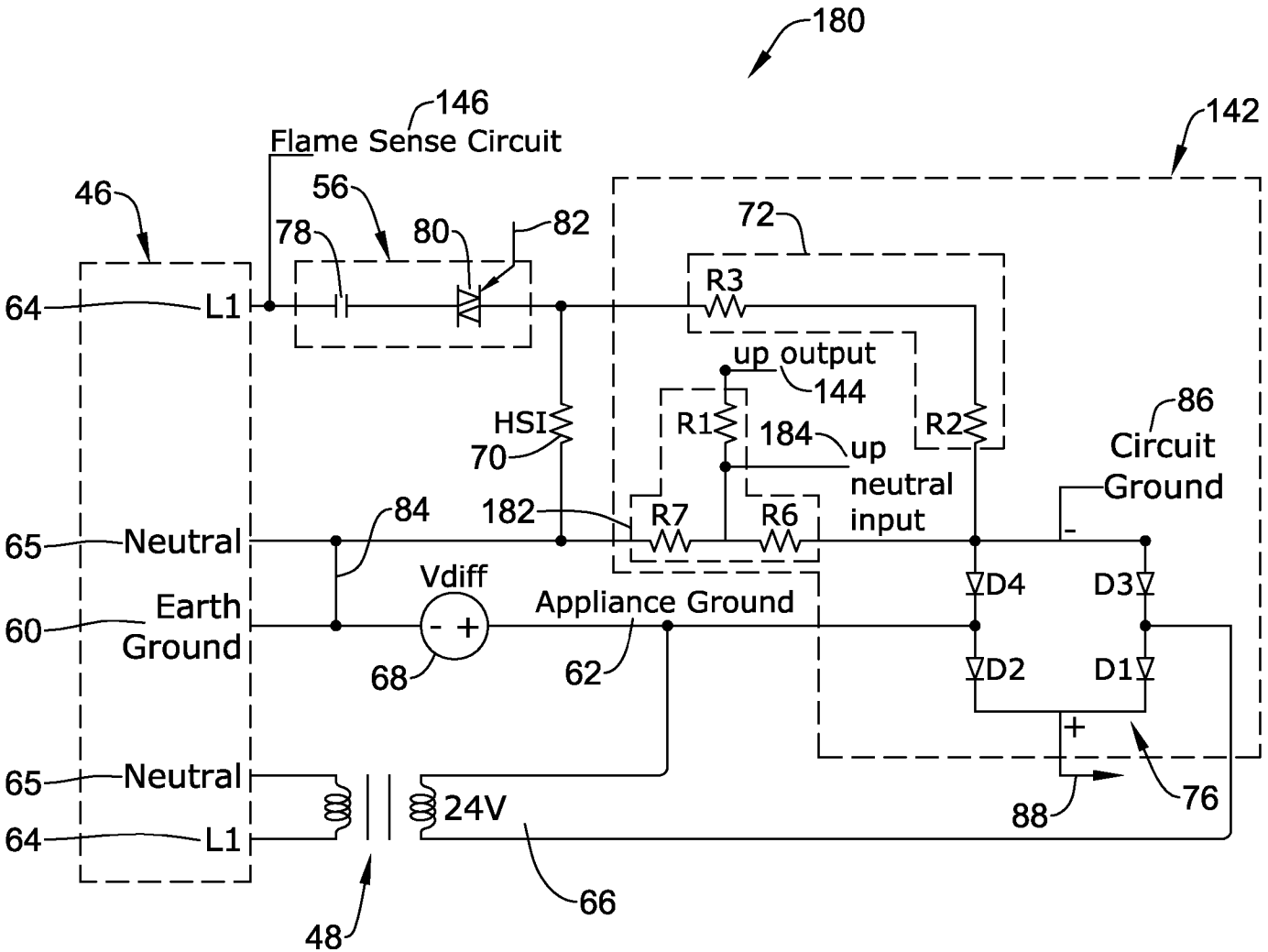
FIG. 12 is a schematic diagram of yet another illustrative embodiment of an ignition control circuit.

FIG. 12 is an illustrative variation of the ignition control circuit of FIG. 8. While similar to FIG. 8, this embodiment is able to sense the voltage difference when the hot surface igniter 70 is activated and/or when it is deactivated. This illustrative embodiment includes a biasing network 182 and an extra input to the microprocessor μp_neutral_input 184. The μp_output 144 biases the biasing network 182. Similar to above, biasing network 182, including R1, R6 and R7, is referenced to circuit ground 86 (see FIG. 8). In the illustrative embodiment, R1 may be about 200 kilohms, R6 may be about 200 kilohms and R7 may be about 4.7 megaohms, providing a similar signal level reduction as described above. In this embodiment, when the hot surface igniter 70 is activated, μp_neutral_input 184 can still see earth ground 60, allowing the microprocessor to determine a measure related to the voltage difference 68 between appliance ground 62 and earth ground 60.

Figure 13:
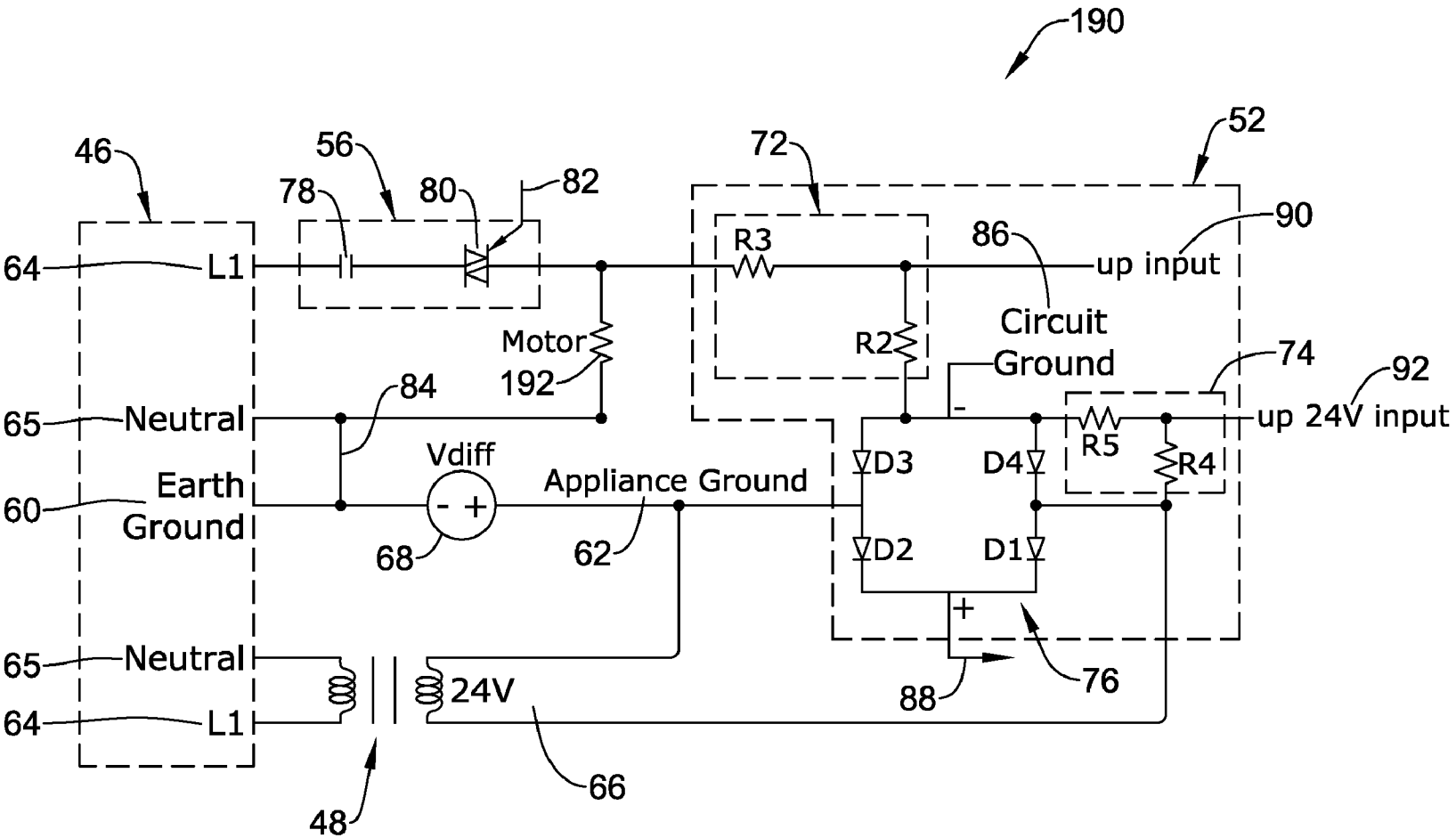
FIG. 13 is a schematic diagram of an illustrative embodiment of an appliance motor control circuit.

FIG. 13 is an illustrative embodiment of an appliance motor control circuit 190. The illustrative embodiment is similar to that described above with reference to the hot signal. To help accommodate this, the voltage across the igniter may be measured when the igniter is off, such as at the peak in FIG. 4. Alternatively, or in addition, the voltage across the igniter may be measured when the igniter is on, such as in FIG. 5. The effect of the 24 volt transformer 48 can be subtracted from the signal. Furthermore, it is contemplated that there are other possible methods of applying the present invention to out of phase power supplies and the foregoing is not meant to be limited to only in phase power supplies.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respect, only illustrative. Changes may be made in details, particularly in matters of shape, size, and arrangement of parts without exceeding the scope of the invention. The invention's scope is, of course, defined in the language in which the appended claims are expressed.

The invention claimed is:

1. A method of operating an ignition controller for an appliance when the appliance includes a circuit referenced to a first ground reference, the method comprising:

supplying an igniter voltage to a hot surface igniter, when the igniter voltage is referenced to a second ground reference;

determining a measure related to the voltage difference between the first ground reference and the second ground reference; and adjusting the igniter voltage based, at least in part, on the measure that is related to the voltage difference between the first ground reference and the second ground reference.

2. The method of claim 1 wherein the circuit is coupled to a transformer with a primary side referenced to the second ground reference and a secondary side that is referenced to the first ground reference.

3. The method of claim 2 wherein the step of determining the measure related to the voltage difference includes providing a first signal referenced to the first ground reference, providing a second signal referenced to the second ground reference, and comparing the first signal to the second signal.

4. The method of claim 3 wherein a voltage difference between the first ground reference and the second ground reference affects the relationship between the compared first signal and second signal.

5. The method of claim 1 wherein the step of determining the measure related to the voltage difference includes providing a first signal referenced to the second ground reference and biasing the first signal with a biasing component.

6. The method of claim 5 wherein a voltage difference between the first ground reference and the second ground reference decreases the voltage of the first signal.

7. The method of claim 1 wherein the first ground reference is an appliance ground.

8. The method of claim 1 wherein the second ground reference is an earth ground.

9. The method of claim 1 wherein the appliance is a furnace.

10. The method of claim 1 wherein the appliance is a boiler.

11. A method of operating an ignition controller for an appliance when the appliance includes a circuit referenced to a first ground reference, the method comprising:

supplying an igniter voltage to a hot surface igniter, when the igniter voltage is referenced to a second ground reference;

providing a signal to a microprocessor referenced to the second ground reference;

biasing the signal referenced to the second ground reference;

determining a measure related to the voltage difference between the first ground reference and the second ground reference; and adjusting the igniter voltage based, at least in part, on the measure that is related to the voltage difference.

12. A method of igniting a hot surface igniter of an appliance, wherein the appliance includes a controller that is referenced to a first ground reference, and the hot surface igniter is ignited by supplying an igniter voltage that is referenced to a second ground reference, the method comprising:

determining a measure related to the voltage difference between the first ground reference and the second ground reference via the control block of the appliance; and supplying one or more control signals from the controller of the appliance to control the igniter voltage during an ignition event, wherein the one or more control signals are based, at least in part, on the measure that is related to the voltage difference between the first ground reference and the second ground reference.

13. The method of claim 12 wherein the first ground reference is an appliance ground.

14. The method of claim 13 wherein the second ground reference is an earth ground.

15. The method of claim 12 wherein the appliance is a furnace.

16. The method of claim 12 wherein the appliance is a boiler.

* * * * *